United States Patent [19]

Buxton

[11] 4,247,005

[45] Jan. 27, 1981

[54] PACKAGE AND PACKAGING METHOD

[75] Inventor: Larry E. Buxton, St. Louis County, Mo.

[73] Assignee: Bemis Company, Inc., Minneapolis, Minn.

[21] Appl. No.: 25,357

[22] Filed: Mar. 30, 1979

[51] Int. Cl.[3] ..... B65D 75/58; B65D 33/06; B65B 61/00; B65B 29/04

[52] U.S. Cl. ..... 206/525; 229/52 AL; 229/65; 53/417; 53/138 A; 53/413

[58] Field of Search ..... 206/525, 219; 229/52 AL, 52 A, 52 R, 65; 53/417, 413, 138 A, 577; 93/35 H

[56] References Cited

U.S. PATENT DOCUMENTS

| | | | |
|---|---|---|---|
| 3,023,948 | 3/1962 | Hoeppner | 229/52 AL |
| 3,095,308 | 6/1963 | Rumsey, Jr. | 53/138 A |

FOREIGN PATENT DOCUMENTS

| | | | |
|---|---|---|---|
| 1184267 | 12/1964 | Fed. Rep. of Germany | 206/525 |

*Primary Examiner*—William T. Dixson, Jr.
*Attorney, Agent, or Firm*—Senniger, Powers, Leavitt and Roedel

[57] ABSTRACT

A package comprising a length of tubular packaging material and an item disposed in the material between first and second clips or staples clinched around bunched portions of the material. The material extends outwardly beyond the second staple, the extension being bunched and fastened by a third staple adjacent its outer end. Strapping extends along the material and is caught by the first, second and third staples. The material and the strapping between the second and third staples provides a handle at one end of the package. A package is made by inserting an item into tubular packaging material previously bunched and fastened together at one end by a first staple; bunching together the material extending rearwardly of the item; extending strapping along the bunched extension of the material; clinching second, third and fourth staples around the bunched extension of the material to fasten the material and the strapping together, the second staple being adjacent the rearward end of the item, the third staple being spaced from the second a distance sufficient to enable the extension of the material and the strapping to form a handle, and the fourth being rearward of and adjacent the third. The bunched extension of the material and the strapping are cut between the third and fourth staples to separate the package from the remainder of the material and the strapping.

14 Claims, 3 Drawing Figures

1
11
19
17
9
13
15
3
5
7

21
27
29
47
3
33
41
5
7
45
49
23
15
25
31
25

33
41
39
35
37
43
19
13
3
11
7
17
9
15

PACKAGE AND PACKAGING METHOD

BACKGROUND OF THE INVENTION

This invention relates to packaging, and more particularly a package comprising an item such as a frozen turkey disposed in tubular packaging material such as tubular plastic netting and a handle at one end of the package, and a method of packaging items in tubular packaging material and providing a handle at one end of each package.

This invention involves an improvement on the prior type of package and packaging method shown, for example, in U.S. Pat. Nos. 3,499,259 and 4,071,063. This prior type of package generally comprises a length of tubular packaging material having an item (e.g., a frozen turkey) disposed within the tubular material between portions of the material bunched and fastened together by fasteners (clips or staples) at the ends of the item. The packaging material extends outwardly beyond the item at one end in a loop to form a handle for the package. In the prior method, the extension of material is bunched together and looped to form the handle, and the end of the bunched material in the loop is caught by the fastener at the said one end of the item. The operations of looping the extension of the tubular material and positioning it for being caught at its end by the fastener for securing the item in the tubular material are time-consuming manual operations, slowing down production of the packages enough to increase their cost.

SUMMARY OF THE INVENTION

Among the several objects of the invention may be noted the provision of a package of the class described with a handle which may be made without any time-consuming looping operation and which is comfortable on the hand in carrying the package; and the provision of a method of packaging items in tubular packaging material, e.g., frozen turkeys in tubular plastic netting, and providing a comfortable handle for the package without looping operations such as heretofore used and with a minimum of additional manual manipulation to provide the handle for more efficient and more economical production of the packages with handles.

In general, a package of this invention comprises a length of tubular packaging material and an item disposed in the tubular material between a first end of the material which is bunched together and fastened by a first fastener and a second and intermediate portion of the material which is bunched together and fastened by a second fastener. The material extends outwardly beyond the second fastener, the outward extension of material being bunched together and fastened at its outer end by a third fastener. A length of strapping is provided extending along the bunched extension of the material and caught in the second and third fasteners, the bunched extension in conjunction with the strapping forming a handle. The method of this invention generally involves inserting an item to be packaged into tubular material previously bunched and fastened together at a first end by a first fastener; bunching together the tubular material extending rearwardly beyond the end of the item away from the first fastener; extending strapping along the bunched extension of said tubular material, applying second and third fasteners to the bunched extension to fasten said material and said strapping together, applying a fourth fastener to the bunched extension at a point rearwardly of the third fastener, and cutting the bunched extension of the material between the third and fourth fasteners to separate each package from the material and strapping extending rearwardly of the package.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
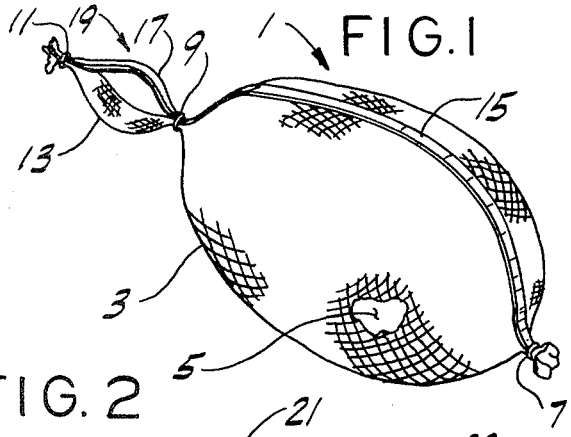
FIG. 1 is a perspective of the package of this invention.

Referring to FIG. 1 of the drawings, there is shown a package 1 of this invention comprising a length of tubular packaging material 3, and an item 5 (e.g., a turkey) disposed in the material between a first end of the material bunched together and fastened by a first fastener 7 and a second and intermediate portion of the material bunched together and fastened by a second fastener 9. A portion 13 of the material 3 extends beyond the packaged item 5 to a second end of the material, this portion being bunched together and fastened at said second end by a third fastener 11. A length of strapping 15 extends along the packaging material and is caught in the first, second and third fasteners. At 17 is indicated a portion of the strapping extending between the second fastener 9 and the third fastener 11. This portion of the strapping in conjunction with the bunched extension 13 of the material 3 forms a handle designated 19.

More particularly, the tubular packaging material 3 may comprise tubular plastic netting material such as that sold under the trade name BE-NET by Bemis Company, Inc. of Minneapolis, Minn. which has been widely used in packaging poultry (especially frozen turkeys) and other items. The length of the packaging material 3 is sufficient to extend not only the full length of the item 5 but also to extend outwardly beyond the item far enough to provide handle 19. Expansion of the tubular material 3 occuring on insertion of item 5 therein reduces the length of the material; thus, the initial length of the material needs to be substantially longer than its final length.

Figure 3:
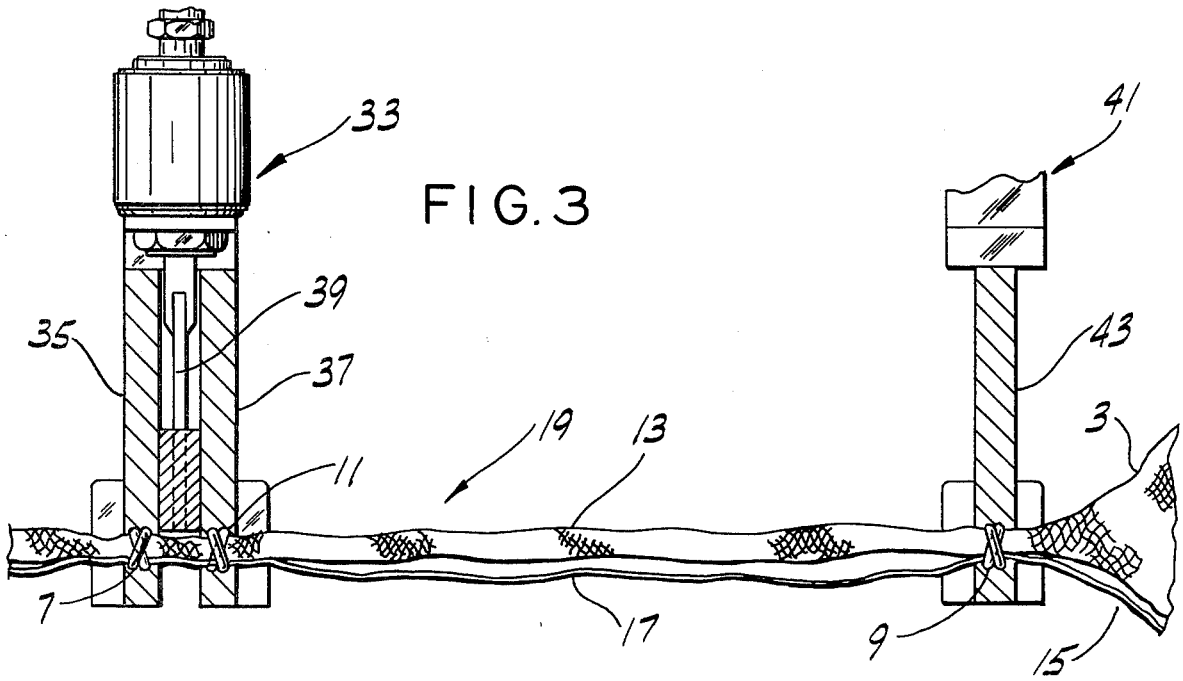
FIG. 3 is an enlarged fragment of FIG. 2, with parts in section, showing certain stapling machines of the apparatus and showing certain staples being applied.

Whatever the shape of the item 5 disposed in the material 3, the item may be regarded as having two ends; one end toward the first fastener 7 and the other away from the first fastener. The package 1 is carried by the handle 19 with the item 5 suspended beneath it. Hence, the end of the item 5 and the end of the package 1 at the first fastener 7 may be considered to be the lower end of the item and the package. The bunched extension 13 of the material extending outwardly beyond the second fastener 9 is fastened at its outer end by the third fastener 11. To provide an adequately sized handle 19 without waste of material, the bunched extension 13 of the material 3 may be about six inches long. As shown, each of the first, second and third fasteners (7, 9 and 11, respectively) comprises a metal staple (a wire clip) clinched around the bunched tubular packaging material (see FIG. 3).

The strapping 15 preferably comprises a relatively wide, thin strip of woven plastic material. It extends along the outside of the tubular packaging material 3 from the bottom end of the package at the first fastener 7 to the outer end of the bunched extension 13 of the material at the third fastener 11. Each of the three fasteners 7, 9 and 11 surrounds the strapping and fastens it to the material 3. The portion 17 of the strapping between the second and third fasteners 7 and 9 constitutes one side of the handle 19.

Figure 2:
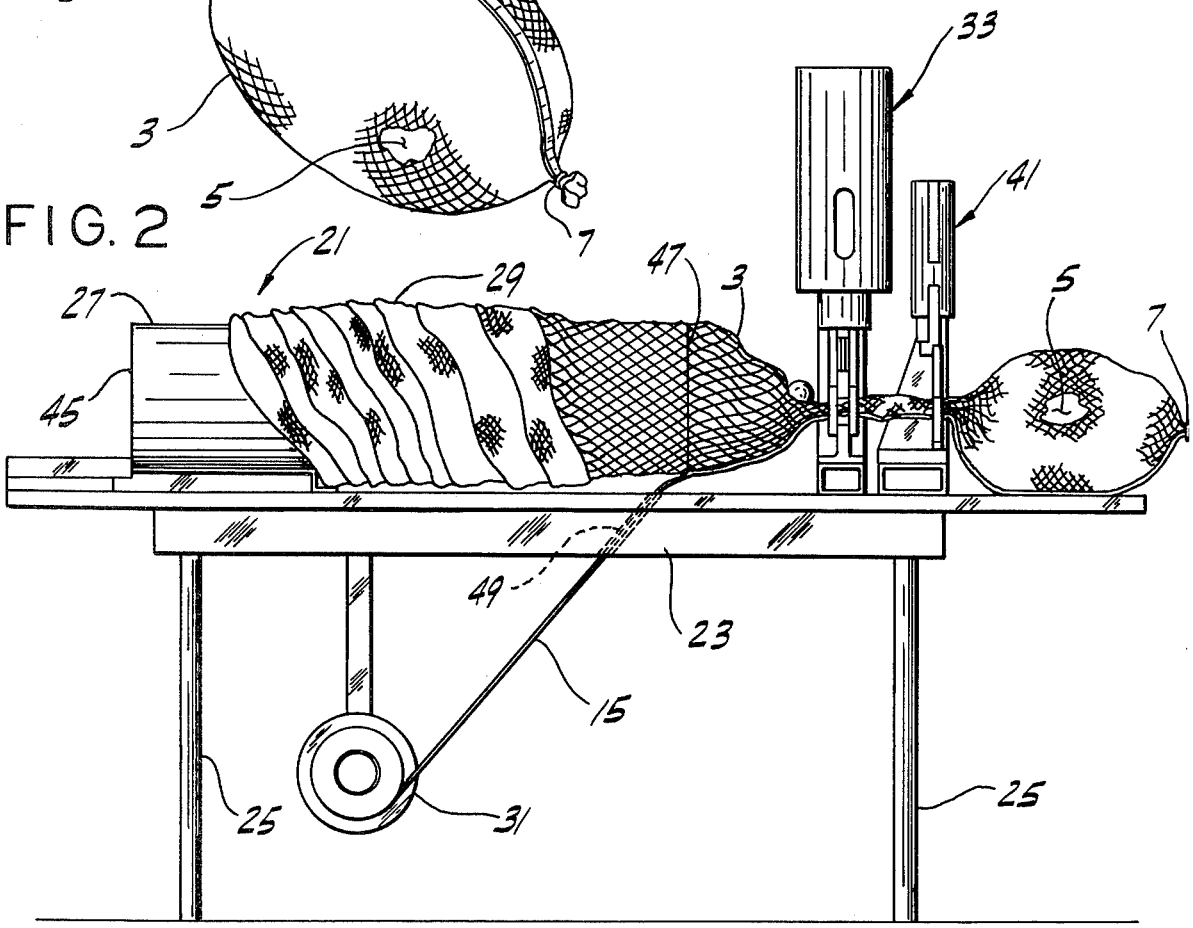
FIG. 2 is an elevation of apparatus used in forming the package.

Generally indicated at 21 in FIG. 2 is packaging apparatus used in forming the package 1. This comprises an elongate table top 23 supported at a convenient elevation on legs 25 and an open-ended loading chute or tube 27 mounted on the table top. A rucked supply 29 of the tubular packaging material 3 is carried on the tube 27. A supply 31 of the strapping 15 (e.g., a roll of the strapping) is mounted beneath the table top 23. A first stapling machine 33 is mounted on the table top 23 adjacent the exit end of the loading tube 27. This first stapling machine has two spaced die members 35 and 37 for clinching two staples in a single cycle around the bunched extension 13 of the tubular packaging material with the two staples spaced along the length of the extension 13 a short distance, e.g., about an inch, and a cutter 39 operable between the two die members for cutting the bunched and stapled extension 13 between the two staples. A second stapling machine 41 is mounted on the table top 23 alongside the first on the opposite side of the first from the exit end of the loading tube 27. This second stapling machine has a single die member 43 spaced the length of the handle (e.g., six inches) from the clincher 37 of the first stapling machine for clinching the staple 9 around the stated intermediate bunched portion of the tubular packing material 3 at what becomes the upper end of the item 5 packaged in the material 3. The two stapling machines are conventional commercially available machines such as sold by Tipper Tie Division of Rheem Manufacturing Company.

The packaging apparatus 21 is utilized for packaging items 5 in the tubular netting 3 and providing the handle 19 on each package in accordance with this invention by inserting an item 5 into the tubular material 3 previously bunched and fastened together at one end by the first fastener 7. Insertion is accomplished by placing the item 5 in the loading tube 27 through its open rear end 45 and by pushing the item 5 through the tube and out of its forward open end 47 into the tubular material 3. A ram (not shown) may be used for pushing the item through the tube and into the tubular material.

Once inserted in the tubular material 3, the item, with the tubular material 3 trailing rearwardly behind it is moved forward away from the loading tube 27 past the stapling machines 33 and 41, respectively. The rearwardly extending portion 13 of the material is bunched together and positioned in the stapling machines 33 and 41 for clinching of staples around the bunched extension at 9 by the second machine and at 11 and 7 by the first. As the item 5 in the tubular material 3 is moved forward away from the forward end 47 of the loading tube 27, strapping 15 (which is caught at its leading end on the previously applied staple 7), is withdrawn from the roll 31 through a slot 49 on the table top 23 and positioned to extend lengthwise along the portion of the tubular material 3 containing the item 5 and along the bunched extension 13 of the material, as shown in FIG. 2. The item 5 in the tubular material 3 is moved forward to the point where the rearward end of the item is just forward of the second stapling apparatus 41. In this position of the item, and with the bunched extension 13 of the material placed in the machines for being stapled, the strapping extends rearward from the staple 7 at the forward end of the tubular material 3 (the bottom end of the package being formed) underneath the portion of the material 3 surrounding the item 5 and underneath the bunched extension 13, and underneath the portion of the material 3 extending from the rucked supply on the tube 27 to the first stapling machine 33.

The stapling machine 41 is then operated with the result that staple 9 is clinched around the bunched intermediate portion of the tubular material 3 and the strapping 15 at the rearward end of the item 5 in the tubular material, thus forming a top closure for the package at the opposite end of the package from the previously applied staple which forms the bottom closure for the package. The stapling machine 33 is also operated with the result that staple 11 and another staple 7 for the next package are clinched around the bunched extension 13 of the tubular material and also around the strapping 15 with the staple 11 spaced rearward a handle length from staple 9, and with the said staple 7 spaced a short distance rearward of staple 11. The cutter is also actuated to cut the bunched tubular material 3 between the staples 11 and 7, thus separating the completed package from the new leading end of the tubular packaging material 3 and the strapping 15, with this leading end of the material 3 bunched together and fastened by the staple 7 and with the strapping caught in staple 7 in readiness for the formation of the next package. It will be observed that this procedure results in the provision of the bunched extension 13 with strapping 15 extending along the outside of this extension and caught in the staples 9 and 11 to form the handle 19.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A package comprising a length of tubular packaging material and an item packaged therein, said item being disposed in said tubular packaging material between a first end of said material which is bunched together and fastened by a first fastener, said end constituting the bottom of the package, and a second and intermediate portion of said packaging material which is bunched together and fastened by a second fastener at the end of the item opposite its bottom end, said tubular packaging material having a further portion extending outwardly from said second fastener, said extending portion of said packaging material being bunched together and fastened at its outer end by a third fastener, and a length of strapping extending along the outside of the bunched extension of the packaging material and caught in said second and third fasteners, the second fastener comprising a staple clinched around the material and the strapping, said bunched extension of said packaging material in conjunction with the strapping forming a handle.

2. A package as set forth in claim 1 wherein said packaging material comprises tubular netting.

3. A package as set forth in claim 2 wherein said tubular netting is plastic netting.

4. A package as set forth in claim 3 wherein said strapping comprises a relatively wide, thin strip of woven plastic material.

5. A package as set forth in claim 1 wherein said strapping extends along the outside of the tubular packaging material from the bottom end of the package to the outer end of said bunched extension of the material and is caught in said first, second and third fasteners.

6. A package as set forth in claim 5 wherein the second and third fasteners each comprise a staple clinched around the material and the strapping.

7. A package as set forth in claim 6 wherein said packaging material comprises tubular netting.

8. A package as set forth in claim 7 wherein said strapping comprises a relatively wide, thin strip of woven plastic material.

9. The method of packaging items in tubular packaging material and providing a handle at one end of each package, comprising:

inserting an item to be packaged into the tubular material previously bunched and fastened together at one end by a first fastener, said item having a first end toward said first fastener and a second away from said first fastener;

bunching together the tubular material extending rearwardly beyond the second end of the item thereby forming a bunched extension of the tubular material;

extending strapping along said bunched extension of the tubular material;

applying second and third fasteners to said bunched extension of said tubular material to fasten said tubular material and said strapping together, said second fastener comprising a staple and being clinched around the bunched extension of said tubular material and the strapping at said second end of said item, said third fastener being applied to said extension at a point spaced rearwardly of the second fastener a distance sufficient to enable said extension of the tubular material and said strapping to form a handle;

also applying a fourth fastener to the bunched extension of said material at a point spaced rearwardly of said third fastener; and cutting said extension of said material between the third and fourth fasteners to separate each package from the material extending rearwardly of the package.

10. The method of claim 9 wherein said fourth fastener applied to said extension of each package constitutes the first fastener of the next package to be formed.

11. The method of claim 9 wherein the item is inserted in the tubular material by having the tubular material on a loading tube with the bunched end of the tubular material fastened by the first fastener at one end of the loading tube and passing the item through the tube from the other end of the tube.

12. The method of claim 9 wherein the strapping has been previously fastened to said tubular material by said first fastener and is extended along said tubular material from said first fastener to said fourth fastener.

13. The method of claim 12 wherein said fourth fastener fastens said material and said strapping together.

14. The method of claim 13, wherein said extension of said material and said strapping between the third and fourth fasteners is cut to separate each package from the material and the strapping extending rearwardly of the package.

* * * * *